US008974196B2

(12) United States Patent
Chen et al.

(10) Patent No.: US 8,974,196 B2
(45) Date of Patent: Mar. 10, 2015

(54) FAN AND BEARING BRACKET THEREOF

(75) Inventors: Yen-Hung Chen, Taoyuan Hsien (TW); Kuo-Tung Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 435 days.

(21) Appl. No.: 12/010,614

(22) Filed: Jan. 28, 2008

(65) Prior Publication Data

US 2009/0047148 A1 Feb. 19, 2009

(30) Foreign Application Priority Data

Aug. 15, 2007 (TW) ..... 96130163 A

(51) Int. Cl.

| | |
|---|---|
| ***F04D 29/05*** | (2006.01) |
| ***F04D 29/64*** | (2006.01) |
| ***F04D 29/056*** | (2006.01) |
| ***F04D 29/66*** | (2006.01) |
| ***F04D 25/06*** | (2006.01) |

(52) U.S. Cl.

CPC ..... *F04D 29/646* (2013.01); *F04D 29/056* (2013.01); *F04D 29/668* (2013.01); *F04D 25/062* (2013.01)

USPC ..... 417/423.14; 417/354

(58) Field of Classification Search

CPC .. F04D 29/046; F04D 29/0462; F04D 29/049

USPC ..... 417/423.15, 360, 354, 423.12, 352, 417/353, 423.1, 423.7, 423.14; 415/220, 415/213.1, 214.1, 229; 384/100, 276, 384/295–296

See application file for complete search history.

(56) References Cited

U.S. PATENT DOCUMENTS

| | | | | |
|---|---|---|---|---|
| 3,941,339 | A * | 3/1976 | McCarty | 248/603 |
| 5,011,379 | A * | 4/1991 | Hashimoto | 417/360 |
| 5,267,757 | A * | 12/1993 | Dal Palu | 285/148.21 |
| 6,144,135 | A * | 11/2000 | Ho | 310/216.079 |
| 6,400,054 | B1 * | 6/2002 | Horng | 310/91 |
| 6,447,272 | B2 * | 9/2002 | Tsuchiya | 417/423.12 |
| 6,726,450 | B2 * | 4/2004 | Lee et al. | 415/230 |
| 6,847,141 | B2 * | 1/2005 | Wang | 310/91 |
| 6,926,497 | B2 | 8/2005 | Lin et al. | |
| 7,484,931 | B2 * | 2/2009 | Ku et al. | 415/229 |
| 7,837,391 | B2 * | 11/2010 | Kitamura et al. | 384/537 |
| 7,862,309 | B2 * | 1/2011 | Chen et al. | 417/423.12 |
| 8,057,168 | B2 * | 11/2011 | Hsu et al. | 415/206 |
| 2004/0000828 | A1 | 1/2004 | Kobayashi et al. | |
| 2004/0136842 | A1 * | 7/2004 | Obara et al. | 417/354 |
| 2004/0141840 | A1 * | 7/2004 | Lin et al. | 415/220 |
| 2006/0013686 | A1 * | 1/2006 | Ku et al. | 415/220 |

(Continued)

FOREIGN PATENT DOCUMENTS

| | | |
|---|---|---|
| CN | 2264820 Y | 10/1997 |
| CN | 2653766 Y | 11/2004 |

(Continued)

*Primary Examiner* — Charles Freay
*Assistant Examiner* — Philip Stimpert
(74) *Attorney, Agent, or Firm* — Birch, Stewart, Kolasch & Birch, LLP

(57) ABSTRACT

A bearing bracket including a metal base and a bushing is provided. The metal base has an opening at its central portion. The bushing of the bearing bracket is made of plastic. The bushing encloses an axial portion or/and a radial portion of the metal base by injection molding. Furthermore, the bearing bracket further includes an anti-vibration member disposed on at least one side surface of the metal base.

25 Claims, 5 Drawing Sheets

(56) References Cited

U.S. PATENT DOCUMENTS

| | | | | |
|---|---|---|---|---|
| 2007/0014675 | A1* | 1/2007 | Nagamatsu et al. | 417/354 |
| 2007/0114860 | A1* | 5/2007 | Chen et al. | 310/67 R |
| 2007/0183907 | A1* | 8/2007 | Serowy et al. | 417/354 |
| 2008/0218018 | A1* | 9/2008 | Zhang et al. | 310/90 |
| 2009/0257869 | A1* | 10/2009 | Li | 415/220 |
| 2010/0322800 | A1* | 12/2010 | Yeh et al. | 417/423.7 |
| 2011/0031832 | A1* | 2/2011 | Jia et al. | 310/90 |

FOREIGN PATENT DOCUMENTS

| | | | |
|---|---|---|---|
| CN | 2691148 | Y | 4/2005 |
| JP | 2000-341907 | A | 12/2000 |
| JP | 2000-350399 | A | 12/2000 |
| JP | 2001-37141 | A | 2/2001 |
| JP | 2003-324929 | A | 11/2003 |
| JP | 3098557 | U | 3/2004 |
| TW | 578860 | U | 3/2004 |
| TW | I282393 | B | 6/2007 |

* cited by examiner

FAN AND BEARING BRACKET THEREOF

BACKGROUND OF THE INVENTION

1. Field of the Invention

The invention relates to a fan and a bearing bracket thereof, and in particular, to a bearing bracket formed by injection and a fan comprising the bearing bracket.

2. Description of the Related Art

As electronic products are developed toward having higher efficiency, higher frequency range, faster speeds and lighter weights, heat produced in electronic products has increased substantially. As a result of excessive heat, instability may occur in electronic products, thus affecting reliability and life-span of the electronic products. Therefore, efficiently dissipating heat in electronic products has become an important subject matter. One method in particular, uses fans. Fans are commonly utilized to dissipate heat in electronic products, and efficiency and cost reduction of fans are two primary tasks of fan development.

As shown in FIG. 1, a conventional fan 1 comprises a metal base 11, a bushing 12, a motor 13 and an impeller 14. The bushing 12, comprising copper or aluminum, and connects with the metal base 11. The motor 13 is telescoped on the bushing 12, and a shaft 131 of the motor 13 is disposed within the bushing 12. The impeller 14, connected with the outer periphery of the motor 13, is rotated by the motor 13.

FIG. 2 depicts another conventional fan 1*a*, wherein the bushing 12*a* of the fan 1*a* connects with the metal base 11*a* by a tight fit or gluing. Considering forces to the overall structure, the bushing 12, 12*a* of the fan 1, 1*a* is made of metal, thus resulting in higher costs.

Therefore, providing a bearing bracket, a motor and a fan with a rigid structure and at a lower cost, is a major task of fan development.

BRIEF SUMMARY OF THE INVENTION

An object of the invention is to provide a bearing bracket and a fan with a rigid structure and at a lower cost.

The invention provides a bearing bracket comprising a metal base and a bushing. An opening is formed on a central portion of the metal base. At least one aperture or a reinforcing part is formed adjacent to the opening. The bushing is integrally formed with the metal base by injection molding.

The invention provides a fan comprising an impeller, a bearing bracket, a stator structure and a rotor structure. The bearing bracket comprises a metal base and a bushing. The bushing encloses an axial portion or/and a portion of a radial portion of the metal base by injection molding, wherein the axial portion fences the opening. The stator structure is telescoped onto the bushing. The rotor structure is disposed corresponding to the stator structure, and the impeller connects with the rotor structure.

The bearing bracket further comprises an anti-vibration member disposed on at least one side surface of the metal base, wherein the anti-vibration member is made of plastic or rubber, and is annular, curved or polygonal. The radial portion of the metal base further comprises at least one through hole or a blind hole, and the anti-vibration member extends into the through hole or the blind hole. The anti-vibration member is adhered to a surface of the radial portion or a recess on the surface of the radial portion.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Referring to the related figures, an exemplary embodiment of the invention discloses a bearing bracket, a motor and a fan, wherein same components are referenced the same for brevity.

Figure 1:
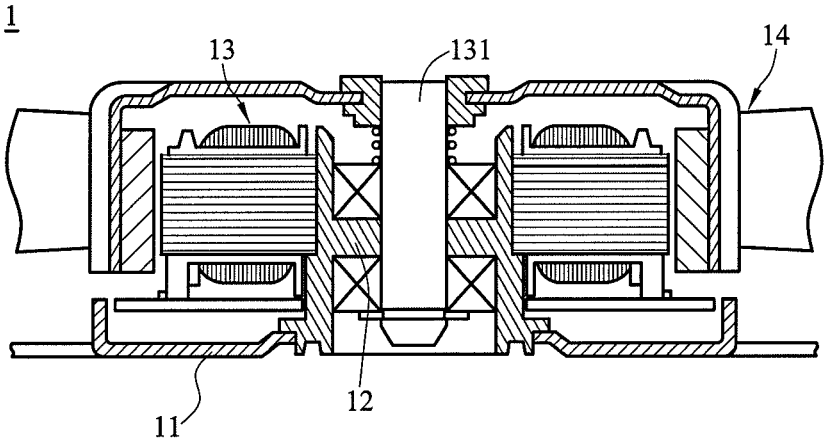
FIG. 1 ( PRIOR ART )
FIG. 1 is a schematic view of a conventional fan.
Figure 2:
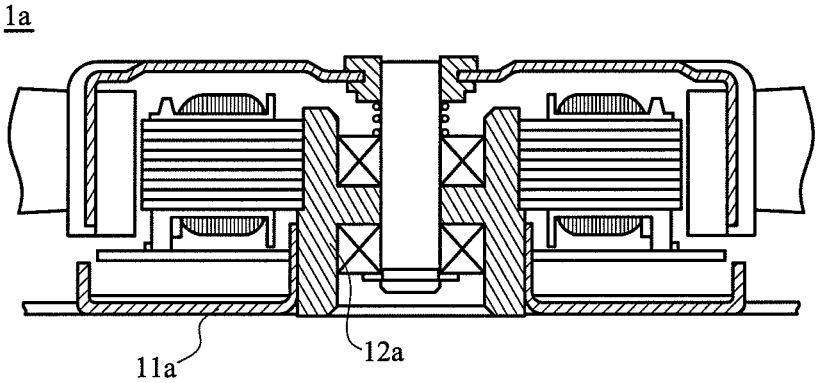
FIG. 2 ( PRIOR ART )
FIG. 2 is a schematic view of another conventional fan.
Figure 3:
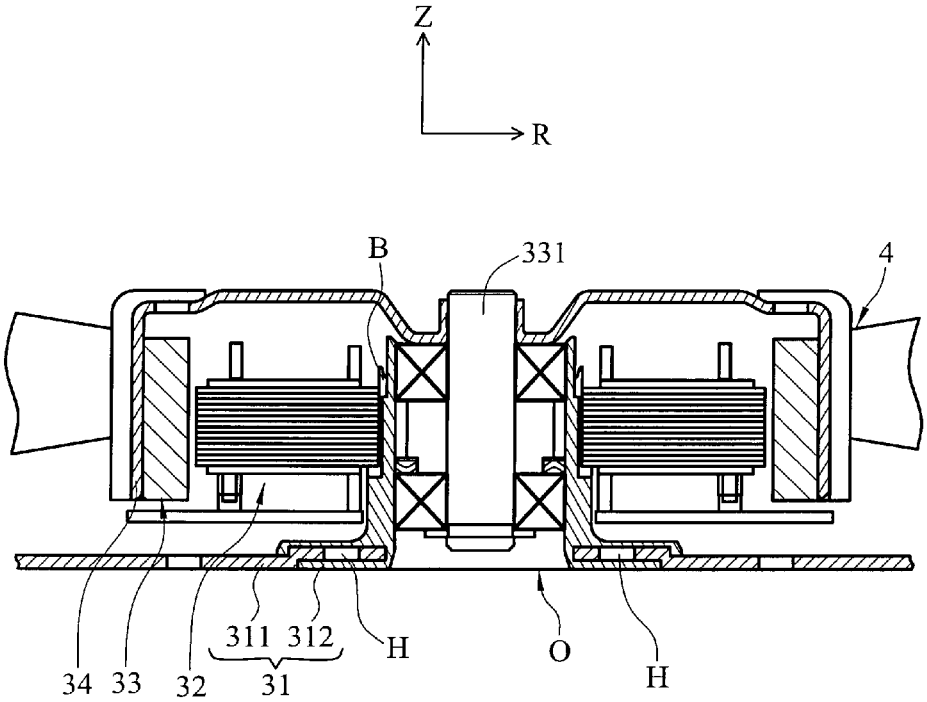
FIG. 3 is a schematic view of a fan of the invention

As shown in FIG. 3, an embodiment of the invention provides a fan comprising an impeller 4, a bearing bracket 31, a stator structure 32, a rotor structure 33 and a magnetizing cover 34. The bearing bracket 31 comprises a metal base 311 and a bushing 312. The metal base 311 comprises an opening O on a center portion thereof and a radial portion with at least one aperture H formed adjacent to the opening O. The radial portion extends in the radial direction R (as shown in FIG. 3). The bushing 312 encloses a portion of the radial portion of the metal base 311 by injection molding. The bushing 312 covers the periphery of the opening O and the aperture H. The metal base 311 comprises pure metal or metal alloys. The bushing 312 is made of plastic, such as cold-curing plastic, thermosetting plastic or light-curing plastic, but it is not limited thereto.

The stator structure 32 and the rotor structure 33 are received in the magnetizing cover 34. The stator structure 32, telescoped onto the bushing 312, comprises a set of silicon steel sheets. Additionally, a stop portion B is formed on the outer periphery of the bushing 312 to limit the axial movement of the stator structure 32. The stop portion B contacts the stator structure 32 and fixes the stator structure 32. The stop portion B is integrally formed with the bushing 312, and protrudes from the outer periphery of the bushing 312. Alternatively, the stop portion B is formed by melting a portion of the bushing 312.

The rotor structure 33 is disposed corresponding to the stator structure 32. The rotor structure 33 comprises a shaft 331 disposed in the bushing 312 and a magnet. The impeller 4 connects with the magnetizing cover 34.

In the embodiment, the stator structure 32, the rotor structure 33 and the impeller 4 are not limited. The main objective of the invention focuses on injection molding when connecting the bushing 312 and the metal base 311, thus reducing costs and enhancing structural rigidity.

In the embodiment, the metal base 311 and the aperture H comprise many variations. FIGS. 4A to 4D are exemplified below, but other variations may be possible.

Figure 4A:
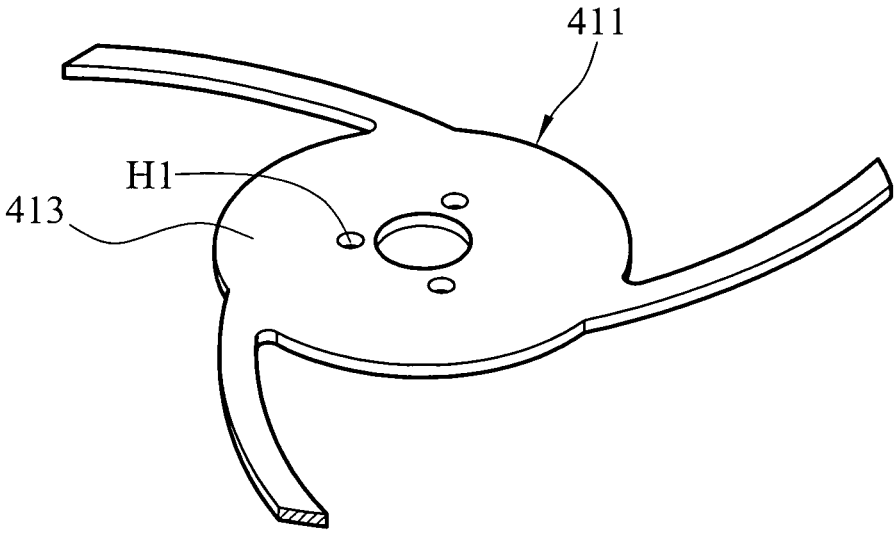
FIGS. 4A to 4D are schematic views showing the fan of the invention with variant combinations of a metal base and an aperture.
Figure 4B:
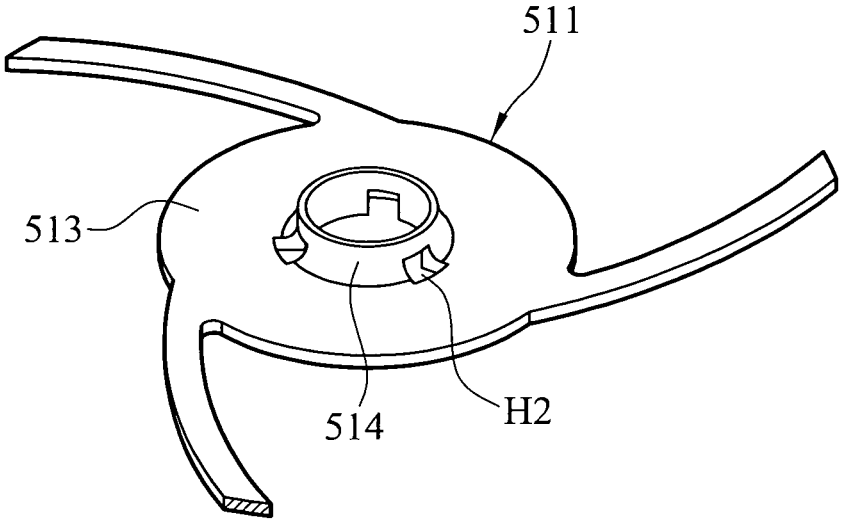

As shown in FIG. 4A, the metal base 411 comprises a radial portion 413. The aperture H1 of the metal base 411 is disposed on the radial portion 413, and is circular. As shown in FIG. 4B, the metal base 511 has a radial portion 513 and an axial portion 514. The aperture H2 of the metal base 411 is trapezoid and disposed on a border between radial portion and the axial portion. That is, the aperture H2 extends from the radial portion 513 to the axial portion 514. The aperture in the embodiment can be in other shapes, such as rectangular or polygonal.

Figure 4C:
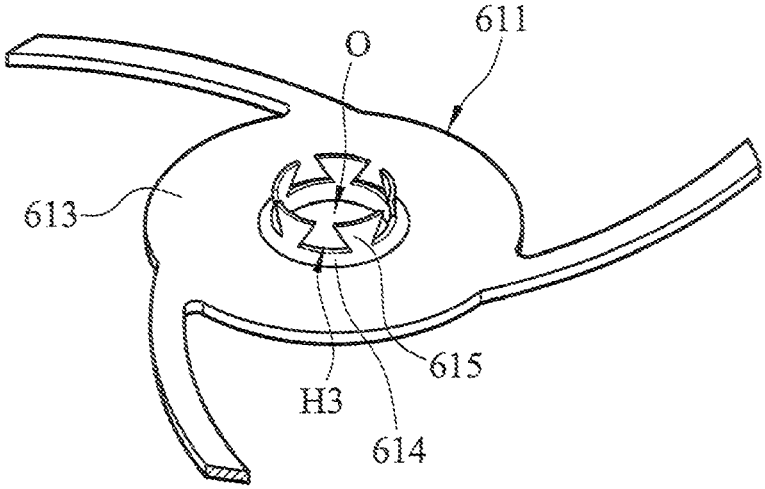
Figure 4D:
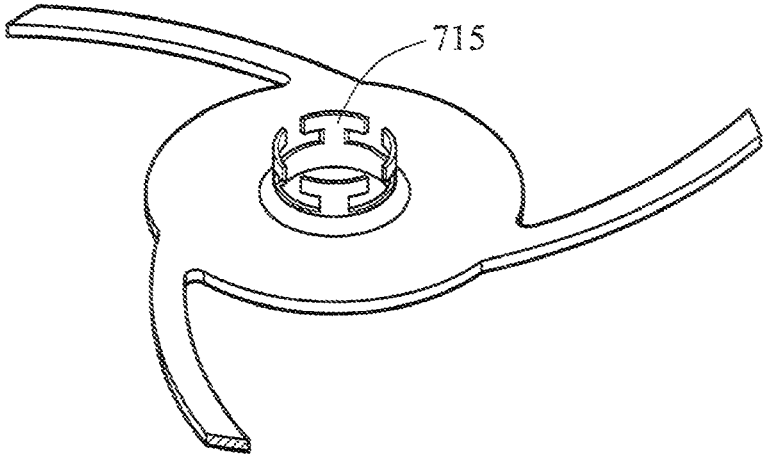

Referring to FIG. 4C, the metal base 611 has a radial portion 613 and an axial portion 614. Besides the aperture H3, the metal base 611 further comprises a reinforcing part 615 disposed on the axial portion 614. When the bushing 312 and the metal base 611 are integrally formed by injection molding, the reinforcing part 615 is also integrally enclosed. The reinforcing part 615 comprises a protrusion, a recess or a combination thereof. The reinforcing part 615 extends from the periphery of the opening O of the metal base 611. In the embodiment, the shape of the reinforcing part 615 is not limited. The reinforcing part 615 can be trapezoid. Furthermore, the reinforcing part 715 is T-shaped in FIG. 4D. The reinforcing part 715 can also be rectangular, circular or polygonal.

Figure 5A:
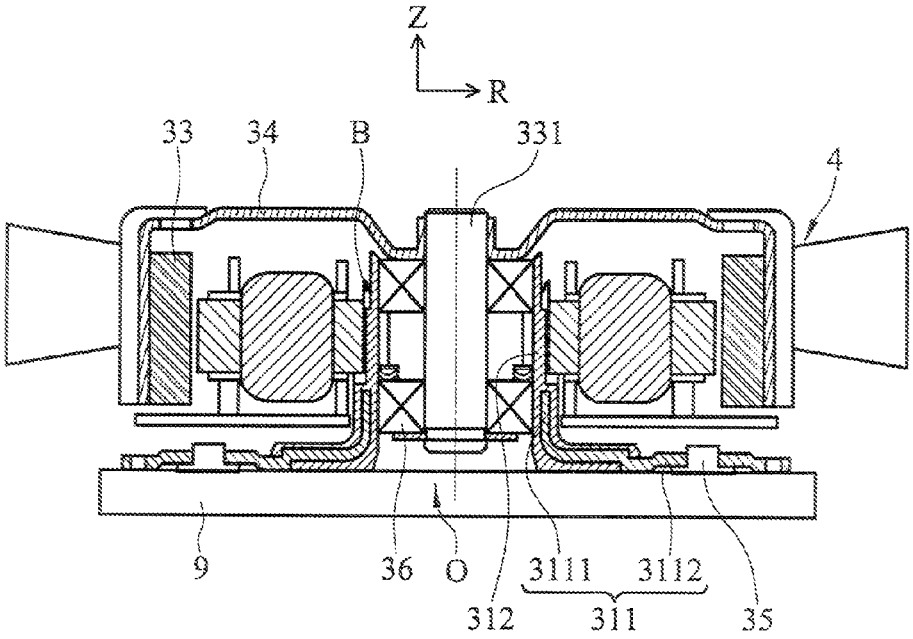
FIG. 5A is a cross sectional view of a variant embodiment of the invention.

*Fig.* 5A is similar to *Fig.* 3. Referring to FIG. 5A, the metal base 311 comprises an opening O, an axial portion 3111 surrounding the opening O, and a radial portion 3112. The axial portion 3111 of the metal base 311 extends in the axial direction Z (as shown in FIG. 5A), and the radial portion 3112 extends in the radial direction R (as shown in FIG. 5A). The bushing 312 encloses the axial portion 3111 and a portion of the radial portion 3112 of the metal base 311 by injection molding. The bearing bracket 31 of the fan further comprises an anti-vibration member 35. A bearing 36 is disposed between the bearing bracket 31 and the shaft 331 of the impeller 4. Additionally, the bearing bracket 31 connects with a fan frame or a system frame 9.

In this embodiment, the metal base 311 is fastened on the fan frame or the system frame 9 by the radial portion 3112. The radial portion 3112 has a coupling structure, an engaging structure, a hole or a recess. The anti-vibration member 35 is disposed on at least one side surface of the metal base 311. It can be disposed between the radial portion 3112 and the fan frame or system frame 9 as shown in FIG. 5A. The anti-vibration member 35 is made of plastic or rubber, and it can be annular, curved or polygonal.

Further, the radial portion 3112 is substantially flat and comprises at least one through hole or blind hole, wherein the anti-vibration member 35 extends into the through hole or the blind hole. Alternatively, the anti-vibration member 35 is adhered to a surface or a recess on the surface of the radial portion 3112. Otherwise, the metal base 311 can also be fastened on the fan frame of the system frame 9 by screwing through the radial portion 3112. The screws and the anti-vibration member 35 can be located in the same though hole or different through holes. Therefore, vibration transmitted through the screws is directly absorbed by the anti-vibration member 35.

Moreover, the advantages of the anti-vibration member 35 are to prevent collision between the metal base 311 and the fan frame or the system frame 9, to reduce noises during the vibration and to increase assembling tolerance between the radial portion 3112 of the metal base 311 and the fan frame or the system frame 9.

Figure 5B:
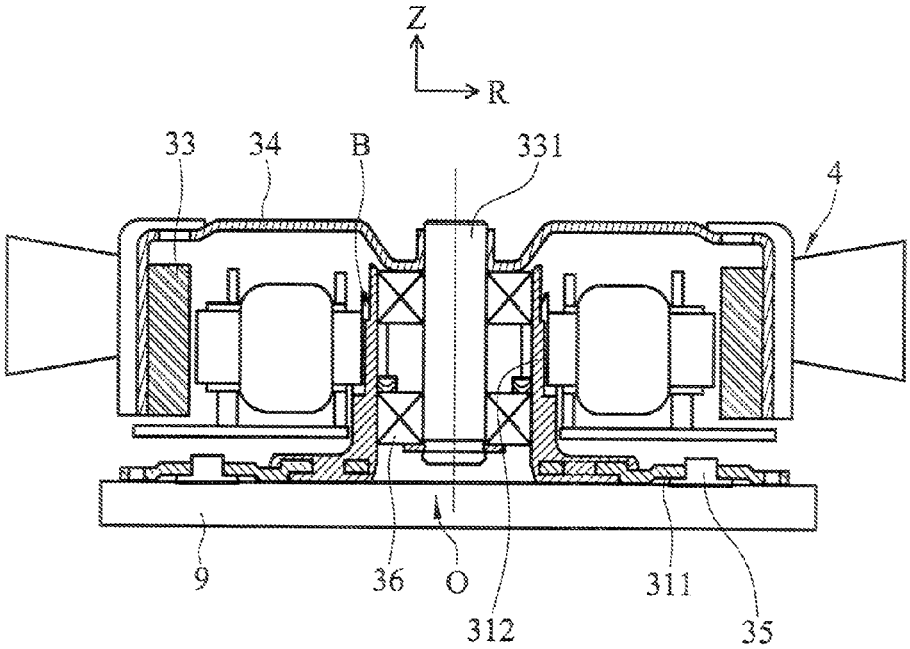
FIG. 5B is a cross sectional view of another variant embodiment of the invention.

*Fig.* 5B is similar to *Fig.* 5 A. FIG. 5B depicts another variant embodiment of the invention showing a cross sectional view of the fan. This embodiment differs from the previous embodiment that the metal base 311 only has the radial portion, and comprising at least one aperture (as shown in dotted line). When the bushing 312 covers the metal base 311, it extends into the aperture to enhance the connection between the metal base 311 and the bushing 312.

The fan of the invention comprises an integrally formed bushing and metal base by injection molding, and the aperture or the reinforcing part is formed adjacent to the opening of the metal base. Compared to conventional fans, the bushing of the invention comprises an injection-formed plastic bushing, such that the cost is lower than the conventional metal bushing. In addition, the bushing connects with the aperture or the reinforcing part, such that the rigidity of the overall structure is assured. Additionally, when the metal base of the bearing bracket of the fan is applied on the fan frame or the system frame, the anti-vibration member between the metal base and the fan frame or the system frame absorbs vibration produced by the bearing bracket during operation of the fan, avoiding failure of the bearing bracket and the connection between the bearing bracket and the fan frame or the system frame. Moreover, the metal base of the bearing bracket of the fan is substantially flat, and the size of the metal base is not limited, such that the metal base does not require changes when applying to different devices. As a result, the bearing bracket is suitable for all kinds of devices, reducing design cost, manufacturing cost and stocks.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan comprising:

a bearing bracket, comprising:

a metal base having an opening formed on a central portion thereof and at least one through aperture formed on a periphery of the opening, wherein the at least one through aperture is disposed on a radial portion of the metal base; and a bushing embedding a portion of the metal base to completely cover the at least one through aperture and extend into the at least one through aperture, such that two ends of the through aperture are completely embedded in the bushing to ensure the structural integrity between the metal base and bushing, wherein the through aperture extends axially from one side surface of the radial portion of the metal base to an opposing side surface of the radial portion of the metal base.

2. The fan as claim 1, wherein the at least one through aperture is formed adjacent to the opening.

3. The fan as claimed in claim 1, wherein the at least one through aperture is circular, trapezoid, rectangular or polygonal.

4. The fan as claimed in claim 1, wherein the bushing is made of plastic, cold-curing plastic, thermosetting plastic or light-curing plastic material.

5. The fan as claimed in claim 1, wherein the bushing comprises a stop portion on a periphery thereof.

6. The fan as claimed in claim 5, wherein the stop portion is integrally formed with the bushing, or formed by melting a portion of the bushing.

7. The fan as claimed in claim 1, wherein the metal base is made of pure metal or metal alloys.

8. A fan comprising:

a bushing embedding a bearing bracket comprising:

a metal base having an opening formed on a central portion thereof, a radial portion and an axial portion, wherein the metal base comprises at least one hollow aperture; and a portion of the metal base;

a stator structure telescoped onto the bushing;

a rotor structure disposed corresponding to the stator structure; and an impeller connected with the rotor structure;

wherein the axial portion is completely embedded in the bushing to ensure the structural integrity between the metal base and the bushing, and wherein the hallow aperture extends axially from one side surface of the radial portion of the metal base to an opposing side surface of the radial portion of the metal base.

9. The fan as claimed in claim 8, wherein the metal base further comprises at least a reinforcing part formed on the radial portion of the metal base.

10. The fan as claimed in claim 9, wherein the reinforcing part comprises a protrusion, a recess or the combination thereof, or the reinforcing part is T-shaped, rectangular, trapezoid, circular or a polygonal.

11. The fan as claimed in claim 8, wherein the bushing is made of plastic, cold-curing plastic, thermosetting plastic or light-curing plastic material.

12. The fan as claimed in claim 8, wherein the bushing comprises a stop portion on a periphery thereof.

13. The fan as claimed in claim 12, wherein the stop portion is integrally formed with the bushing, or formed by melting a portion of the bushing.

14. The fan as claimed in claim 8, wherein the metal base is made of pure metal or metal alloys.

15. The fan as claimed in claim 8, further comprising an anti-vibration member disposed on at least one side surface of metal base.

16. The fan as claimed in claim 15, wherein the anti-vibration member is made of plastic or rubber, and is annular, curved or polygonal.

17. The fan as claimed in claim 16, wherein the metal base has at least one through hole or at least one blind hole for allowing the anti-vibration member to adhere or to extend therein.

18. The fan as claimed in claim 8, wherein the axial portion of the metal base is formed adjacent to the opening.

19. A fan comprising:

a bearing bracket, comprising:

a metal base having an opening formed on a central portion thereof, a radial portion and an axial portion, and at least one reinforcing part formed on the axial portion, a through aperture disposed on a border between the radial portion and the axial portion;

a bushing embedding a portion of the metal base to cover the reinforcing part, such that the reinforcing part is completely embedded in the bushing to ensure the structural integrity between the metal base and the bushing, wherein the through aperture extends axially from one side surface of the radial portion of the metal base to an opposing side surface of the radial portion of the metal base.

20. The fan as claimed in claim 19, further comprising an anti-vibration member disposed on at least one side surface of metal base.

21. The fan as claimed in claim 20, wherein the anti-vibration member is made of plastic or rubber, and is annular, curved or polygonal.

22. The fan as claimed in claim 20, wherein the metal base has at least one through hole or at least one blind hole for allowing the anti-vibration member to adhere or to extend therein.

23. The fan as claimed in claim 19, wherein the through aperture is circular, trapezoid, rectangular or polygonal.

24. The fan as claimed in claim 19, wherein the reinforcing part comprises a protrusion, a recess or the combination thereof, or the reinforcing part is T-shaped, rectangular, trapezoid, circular or a polygonal.

25. The fan as claimed in claim 19, further comprising an aperture disposed between two adjacent reinforcing parts.

* * * * *